US006233897B1

(12) United States Patent
Jurik

(10) Patent No.: US 6,233,897 B1
(45) Date of Patent: May 22, 2001

(54) LANDSCAPING BLOCK

(76) Inventor: Dean Jurik, 5131 N. 15 Rd., Mesick, MI (US) 49668

( * ) Notice: Subject to any disclaimer, the term of this patent is extended or adjusted under 35 U.S.C. 154(b) by 0 days.

(21) Appl. No.: 09/004,770

(22) Filed: Jan. 9, 1998

Related U.S. Application Data

(60) Provisional application No. 60/035,240, filed on Jan. 9, 1997.

(51) Int. Cl.[7] ..... E04B 1/04; E04C 1/00

(52) U.S. Cl. ..... 52/604; 52/102; 52/592.6; 52/608

(58) Field of Search ..... 52/604, 608, 102, 52/590.2, 592.6

(56) References Cited

U.S. PATENT DOCUMENTS 4,914,876 * 4/1990 Forsberg ..... 52/168.4
4,965,979 * 10/1990 Larrivee et al. ..... 52/585
5,119,587 * 6/1992 Waltz ..... 47/33
5,337,527 * 8/1994 Wagenaar ..... 52/169.2
5,361,557 * 11/1994 Snyder et al. ..... 52/608
5,421,135 * 6/1995 Stevens et al. ..... 52/604
5,651,642 * 7/1997 Kelley, Jr. et al. ..... 405/286

* cited by examiner

*Primary Examiner*—Christopher T. Kent
(74) *Attorney, Agent, or Firm*—Douglas S. Bishop

(57) ABSTRACT

A block for landscaping purposes. The landscaping block has one generally planar surface and another corresponding generally parallel planar surface, which further defines a protrusion and a cavity conformed to receive another protrusion of the same dimension in a male/female relationship with the planar surfaces of the block in close proximity and parallel to each other. Two or more of the landscaping blocks may best be joined together by inserting the protrusion of one block into the conformed cavity of the next block. A series of blocks may be joined together either in an extended line, or in a shape which reaches closure, with all of the blocks interlocked.

18 Claims, 5 Drawing Sheets

FIG-7
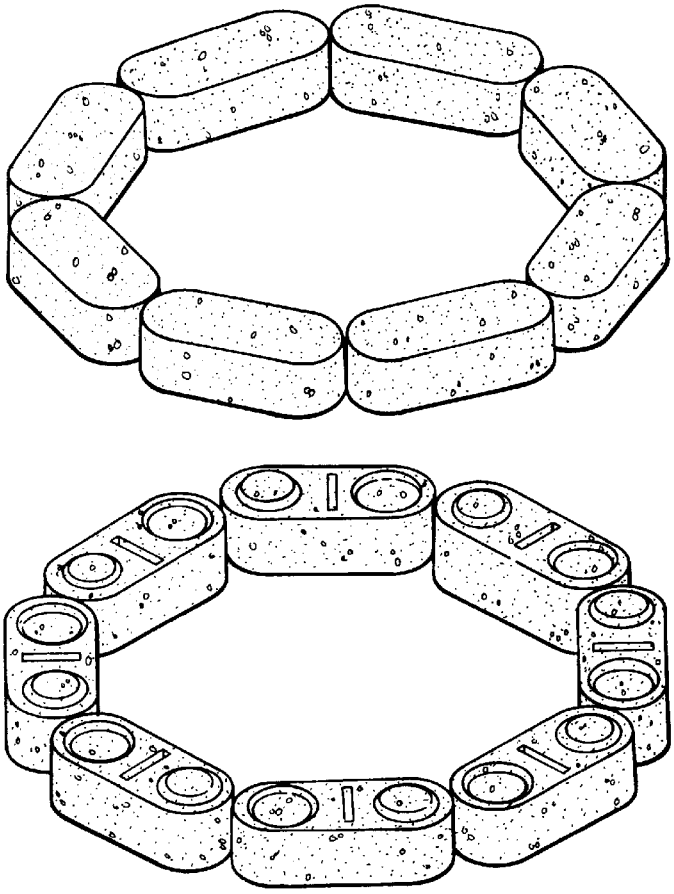
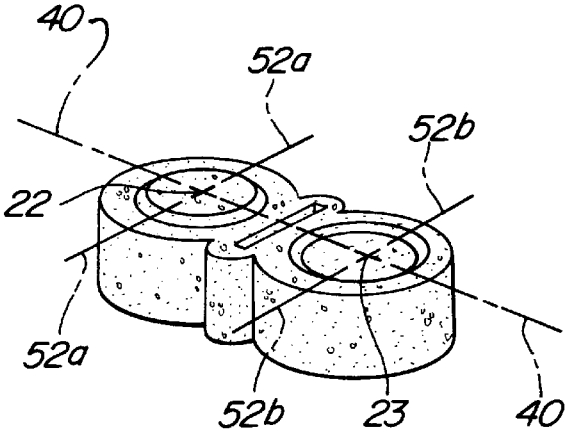
FIG-8
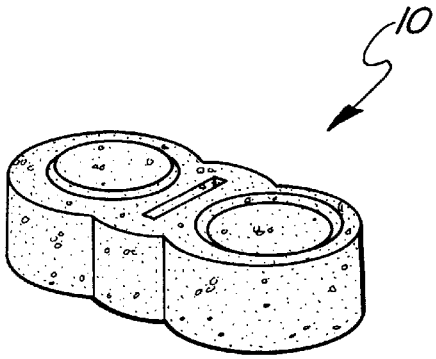
FIG-9

LANDSCAPING BLOCK

PRIOR PROVISIONAL APPLICATION

Applicant claims the benefit under 35 usc 119(e) of provisional application No. 60/035,240, filled Jan. 9, 1997.

FIELD OF THE INVENTION

This invention relates to the field of construction, in building or retaining blocks, more particularly, blocks utilized in landscaping applications.

This field encompasses plants surrounds, lawn edges, interlocking concrete pavers edges, flower beds and the like. The current invention is designed to be part of a system comprised of a number of identical one-piece units accomplishing all of the above applications, while interlocking with each other without the utilization of any additional materials or components.

BACKGROUND OF THE INVENTION

The concept of using blocks, or other elements for retaining soil, or other landscaping applications, is known. U.S. Pat. No. 5,119,587, issued to Waltz, provides for irregularly shaped landscaping blocks which have holes provided through extending portions, so that an additional element may be extended through the blocks, holding them in place. U.S. Pat. No. 1,634,357, issued to Himmelright, discloses a refractory block wherein one block has a pair of nubs, or protrusions on one side, and a corresponding set of indentations on the other side of the block. A similar concept is disclosed in U.S. Pat. No. 5,230,195, issued to Sease, which likewise discloses a pair of protrusions on one side of the block with a pair of corresponding indentations on the opposing side. U.S. Pat. No. 5,505,034, issued to Dueck, also discloses a retaining block utilizing extensions, or nubs, as a connecting feature. Documentation of Adam Sehring & Söhne, a German manufacturer, discloses a retaining wall block element which requires the use of a fastening device which is not inherent within the retaining wall block element itself.

There are many products which are utilized as landscaping blocks. None, however, incorporate the particular features of the instant invention. The Waltz patent, and similar applications, also lack the ability to make angles of 90° or greater and demand the use of additional pieces or pins to provide interlock, or the use of a "cap block" to give the project a finished look, as, often, unless two different types of blocks are used, the upper level of the block, without the "cap block," would show the perforations or indentation used to interlock the blocks. Other known uses include smaller retaining wall blocks which comprise a one-piece system, but do not have the ability to interlock with each other and have to be cut to produce corners. There is no previously known system utilizing a singular unit only, which provides interlock, allows up to 180° exterior angles in a landscaping project perimeter and which may be easily produced on a conventional block or paver-producing machine. In addition to blocks, timbers and treated 2×4's, among other materials, have been utilized as landscaping blocks for edges and surrounds, as well as for flower planters and the like. Such wood products have to be cut in length and fastened mechanically. They are subject to decay and deterioration as well. Conventional clay bricks and concrete blocks have also been used, but provide no interlockings or horizontal or vertical fastenings, which allows for movement between the elements. Small retaining wall blocks may solve the vertical interlock problem, but do not address the horizontal interlock. Small retaining wall blocks also require cutting to make corners and many need pins to interlock and a cap to finish the top to provide the appearance of a smooth unitary surface. Others may require multiple pieces for interlock. Poured-in-place concrete has also been used, but requires more excavating, needs finishing after placement, is prone to cracking, and cannot be transported in units.

The ideal solution for a landscape block would require only one piece, provide interlock both horizontally and vertically, be able to be installed making angles up to 180°, be useful for planters, edges, surrounds and steps, be able to be produced with minimal labor on a conventional block machine, be easily made and packaged, be easy to install and long-lasting, all the while requiring very little modifications to complete a project. While a number of products currently being used as landscaping blocks may fill one or more of these requirements, none, save the present invention, fulfills all of them. The Waltz patent and other similar applications require multiple pieces and do not allow for corners of 90° or more and are difficult if not impossible to fabricate on conventional block machines. The invention disclosed by Dueck, and other similar inventions, requires modification to make square corners and angles of 45° or more, and most require cap blocks to finish the product. Conventional bricks and blocks, as stated, do not provide any type of interlock, allowing for excessive movement. Accordingly, it is desirable to provide a landscaping block which is comprised of a singular unitary piece, can provide interlock both vertically and horizontally, which can be made on the conventional block machine, which can be utilized to form landscaping structures including angles of up to 180°, which may provide positive interlock and which interlock may permit rotation from the point of interlock or may not.

SUMMARY OF THE INVENTION

This invention is directed to provision of a landscaping block which will permit functional and aesthetic landscape designs, and ease of installation, replacement and modification. It was disclosed in a provisional application entitled "Box Blocks," filed Jan. 9, 1997.

More specifically, this invention is directed to provision of a homogeneous landscape block which may be used in combination with other like blocks, only, to provide landscaping structures.

An additional feature of the invention is to provide a landscaping block which, without the need for additional components, may interlock on both a horizontal, and a vertical, basis in landscaping structures.

According to an important feature of the invention, the landscaping block has at least one generally planar surface which, in landscaping applications would either the directed downward, or upward. This planar surface, additionally, contains a protrusion and an indentation which correspond in size with each other so that the protrusion of one block and the corresponding indentation of another block may be readily joined together in a male/female relationship. In the preferred embodiment of the invention, the protrusion is in the form of an extended, truncated cone, and the indentation is in the form of an indented truncated cone. However, broadly considered, the protrusion and corresponding male/female indentation would be in any corresponding geometric shapes which permit interlock in a male/female relationship.

According to a further feature of the invention, in the preferred embodiment, the block is generally longer than it is wide, and the protrusion and corresponding indentations are located along a line generally bisecting the planar surface in a lengthwise manner.

According to a further feature of the invention, the block has a first and a second generally planar surface, the first containing the above-mentioned protrusion and corresponding indentation.

According to a further feature of the invention, in the preferred embodiment, the protrusion and corresponding indentation are each centered on a line bisecting the block lengthwise and are further located so that the protrusion is centered on one half of the length of the block and the corresponding indentation is centered in the other one half of the length of the block.

According to a further feature of the invention, in the preferred embodiment, a plurality of blocks may be utilized to create structures in generally circular, rectangular, polygonal, elliptical, or other geometric forms, and to provide structures which close and structures which do not close.

According to a further feature of the block, the block is scored, or grooved, between the protrusion and indentation, to provide a means to divide the block into two separate sections for utilization in structure construction.

According to a further feature of the block, the block may be constructed of brick, concrete or ceramic tile composition, or other like suitable material.

According to a further feature of the invention, the planar surface, or surfaces of the block, may be rectangular, may have straight sides with semicircular ends, and may be otherwise polygonal, or elliptical, or of other geometric shapes consistent with the spirit of the invention.

BRIEF DESCRIPTION OF THE DRAWINGS

FIG. 7 is an expanded view of the structure showing FIG. 6;

FIG. 8 is a perspective view of a stylized block;

FIG. 9 is a perspective view of an alternative stylized block;

DETAILED DESCRIPTION OF THE PREFERRED EMBODIMENT

Figure 1:
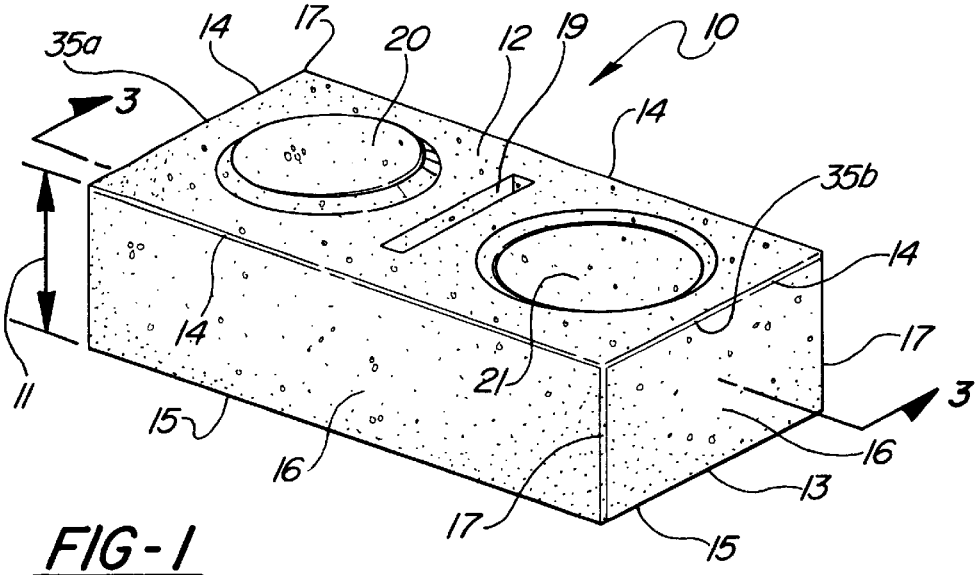
FIG. 1 is a perspective view of a preferred embodiment of the block embodying this invention, showing the same in rectangular form.

The invention block for landscaping and like purposes, broadly considered, includes a block 10 element having a vertical dimension 11.

In the preferred embodiment, the block 10 comprises a first generally planar surface 12 and a corresponding second generally planar surface 13. The first planar surface 12 and second planar surface 13 face oppositely outward and are substantially parallel as shown in FIG. 3. The perimeter of the first planar surface 12 is defined by a first unitary edge 14 which extends completely around it. The corresponding perimeter of the second planar surface 13 is defined by a second unitary edge 15 which extends completely around it. A unitary side surface 16 extends between the first unitary edge 14 and the second unitary edge 15. The side surface 16 encloses the depth dimension 11 of the block 10. As shown in FIGS. 3, 1, 2, 4, 5, 6, 7, 8, 9, 10, 11, 12 and 13, the combination of the first planar surface 12, second planar surface 13 and unitary side surface 16 define the outward shape of the block 10.

Figure 2:
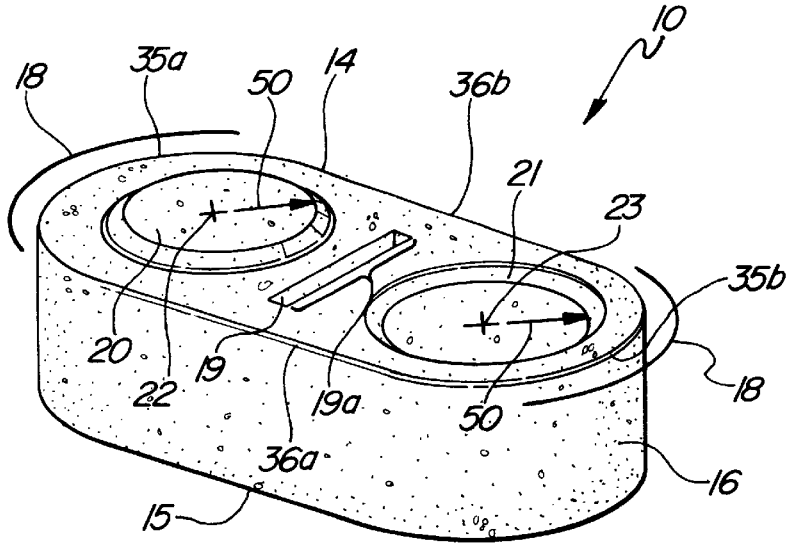
FIG. 2 is a perspective view of a preferred embodiment of the block embodying this invention, showing the same with semicircular ends.
Figure 3:
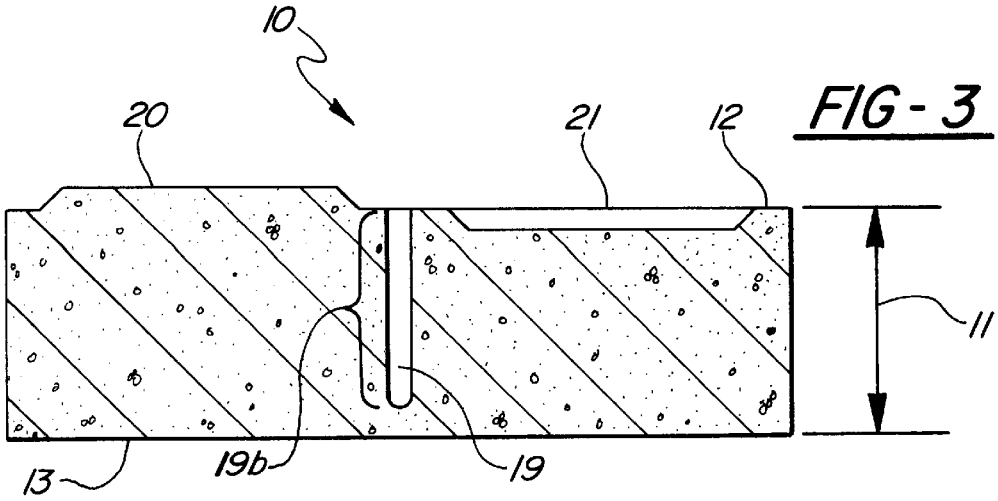
FIG. 3 is a cross-sectional view taken on line 3—3 of FIG. 1.

The unitary side surface 16, in enclosing the block 10, between the first planar surface 12 and second planar surface 13, in order to reach closure, may do so by angled corners 17 as shown in FIG. 1, or by curvature 18 of the side surface 16 as shown in FIG. 2, or by combination thereof. The planar surfaces 12 and 13 each have a corresponding length 30 and a corresponding width 31. The length 30 is at least as long as the width 31. In the preferred embodiment, the planar surfaces 12 an 13 each have a corresponding length 30 which is approximately twice the corresponding width 31 of each of said planar surfaces 12 and 13. Each of the planar surfaces 12 and 13 has two ends, 35*a* and 35*b*, and two sides, 36*a* and 36*b*.

The first planar surface 12 has a nub or protrusion 20 extending outwardly from it and a corresponding indentation 21 defined on the first planar surface 12 and extending into the depth dimension 11 of the block 10. The indentation 21 is geometrically conformed to the protrusion 20 so that the protrusion 20 of a like block 10 will fit within the indentation 21 in a male/female relationship.

Figure 12:
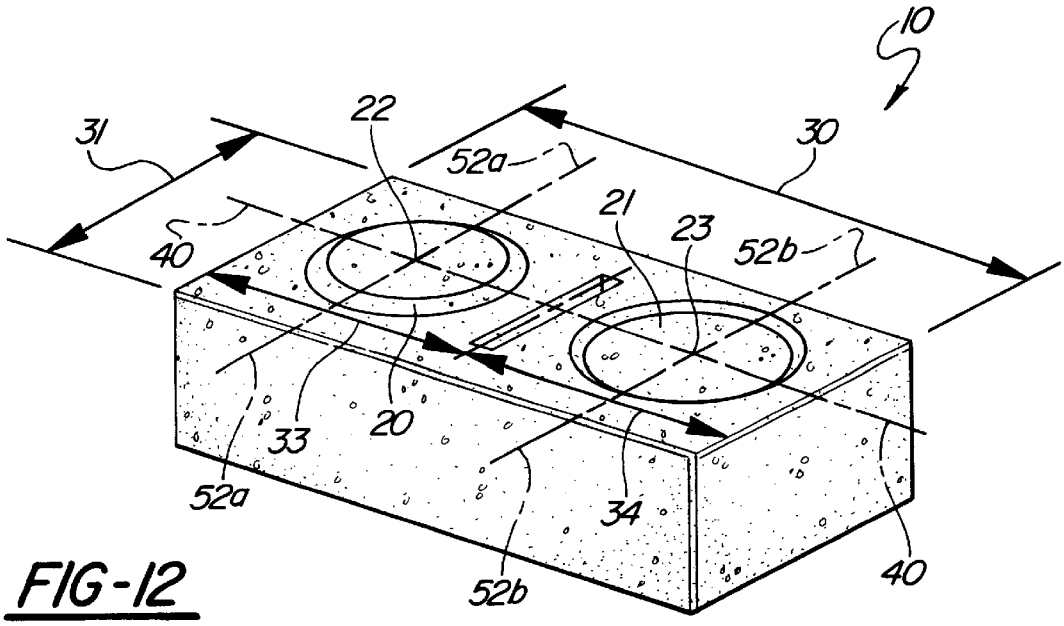
FIG. 12 is a perspective view of a preferred embodiment of the invention in rectangular form, showing preferred relative dimensions.
Figure 13:
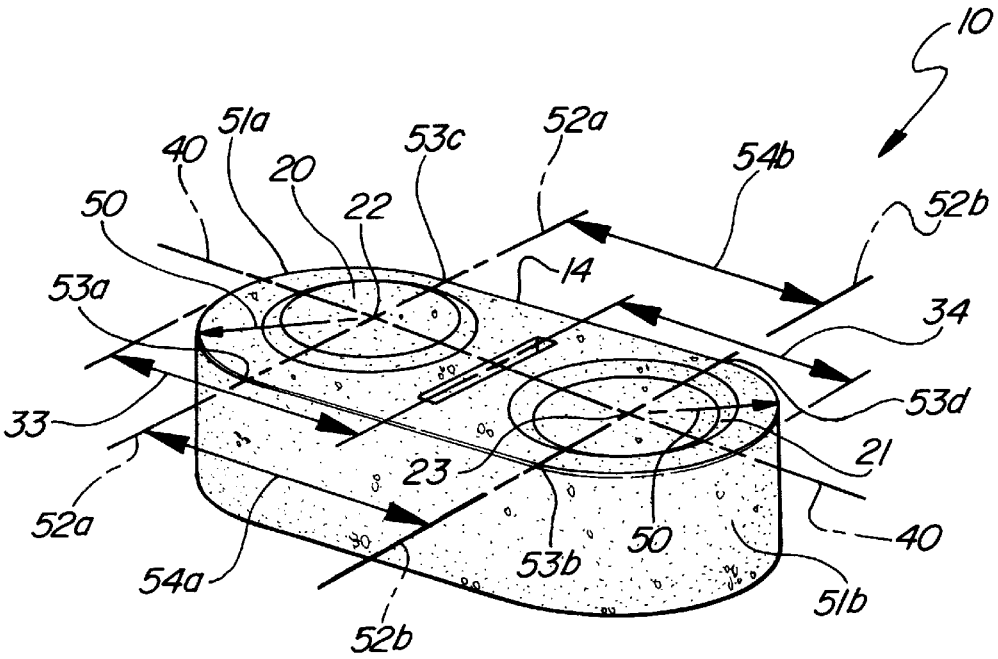
FIG. 13 is a perspective view of a preferred embodiment of the invention with semicircular ends showing preferred relative dimensions.

The protrusion 20 and indentation 21 are aligned along a line 40 which bisects the first planar surface 12 along its length 30. As shown in FIGS. 12 and 13, the protrusion 20 is centered at a point 22 located so as to bisect a first one half 33 of the length 30. The indentation 21 is centered at a point 23 so as to bisect the corresponding second one half 34 of the length 30. Accordingly along the line 40 bisecting the first planar surface 12 the protrusion 20 is centered at a point 22 which divides length 30 in a ratio of three to one and the indentation 21 is centered at another point 23 which likewise divides length 30 in a ratio of three to one.

To further illustrate, as shown in FIGS. 12 and 13, in the preferred embodiment, the protrusion 20 and the indentation 21 are centered at points 22 and 23 on length 30 along line 40 so that the distance between points 22 and 23 is approximately equal to one half of the length 30 of the first planar surface 12, with point 22 being a distance approximately equal to one fourth of length 30 from end 35*a* and point 23 being a distance approximately equal to one fourth of length 30 from end 35*b*.

While the preferred embodiment of the block 10, as herein disclosed, displays a second planar surface 13, corresponding with the first planar surface 12, block 10 requires only the first planar surface 12, to provide the most obvious benefits of the invention. The opposing surface may, accordingly, be adaptable to other geometric configurations without departing from the spirit of the invention.

Likewise, the shape of the first planar surface 12 (and, correspondingly, the second planar surface 13) may be subject to various geometric variations, including polygonal and elliptical variations, or a combination of them. In the preferred embodiment, said planar surface 12 is rectangular, as shown in FIG. 1, with the ends 35*a* and 35*b* essentially parallel, or, as shown in FIG. 2, ends 35*a* and 35*b* may be substantially semicircular about a radius 50, from points 22 and 23 respectively. In the latter instance, as shown in FIG. 12 the unitary edge 14 is defined by ends 51*a* and 51*b* which are outwardly semicircular at ends 35*a* and 35*b*, at points 53*a*, 53*b*, 53*c* and 53*d* on the said unitary edge 14 defined by the intersection of the edge 14 with two lines 52*a* and 52*b* perpendicular to line 40 and running through points 22 and 23, respectively, together with two parallel lines 54*a* and 54*b*, joining points 53*a* and 53*b*, and 53*c* and 53*d*, respectively.

As may be seen in FIGS. 8, 9, 10 and 11, the benefit of the preferred embodiment remains present with various ornamental variations in the shape of unitary side surface 16 and corresponding unitary edges 14 and 15. The variations demonstrated in FIGS. 8 through 11, specifically retain the relative dimensions of length 30 and width 31 where length 30 is measured along line 40 and width 31 is measured along lines 52*a* and 52*b*.

In an additional preferred embodiment of the invention, the first planar surface 12 of the block 10 contains an aperture or groove 19. Said groove 19 extends inwardly, perpendicular to the planar surface 12 into the depth dimension of block 10. Groove 19 is linear on first planar surface 12 along its width 31 dimension, between sides 36*a* and 36*b*. It is of a lesser length 19*a* than width 31 and it extends inwardly at a lesser depth 19*b* than the length of depth dimension 11, so that the groove is visible on first planar surface 12, but not visible on second planar surface 13, or on unitary side surface 14, on either side 36*a* or 36*b*. Said groove 19 provides a breakpoint for dividing block 10 into separate sections, for structure finishing purposes where a combination of blocks 10 does not reach closure in the manner shown in FIGS. 4 and 6. In the preferred embodiment of the invention, groove 19 is located equidistant between protrusion 20 and protrusion 21 on first planar surface 12.

Figure 14:
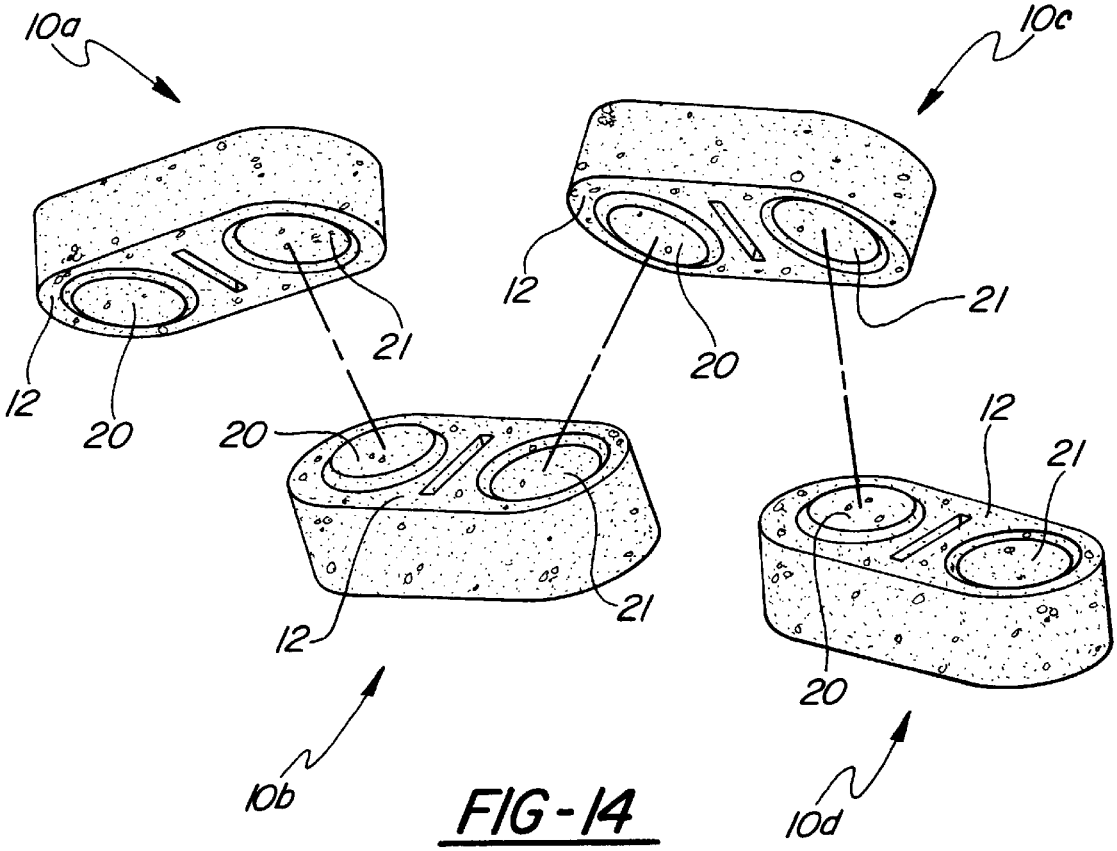
FIG. 14 is an exploded view of a section of four blocks from a structure of blocks.

In a further preferred embodiment of the invention, the protrusion 20 is in the shape of a truncated cone extending outwardly from the first planar surface 12. Likewise, in corresponding with the shape of protrusion 12, indentation 13 is conformed in the shape of an inverted truncated cone so as to be able to accept the protrusion 12 of another like block 10 in a male/female relationship. The truncated cone embodiment of protrusion 12 is shown in FIGS. 1, 2, 3, 5, 7, 8, 9, 10, 11, 12, 13 and 14. The truncated cone design facilitates interlock between blocks 10 when used in combination as shown in FIG. 14, by allowing a first block 10 to interlock with a second block 10 through the respective protrusion 12 of one block and the indentation 13 of the other without requiring exact vertical alignment prior to initiating the male/female alignment between the first block 10 and the second block 10. In each case of interlock between protrusion 20 of a block 10 and an indentation 21 of a like block 10, or vice versa, the first planar surface 12 of the interlocking blocks 10 will be proximate the first planar surface of the other block 10. Said design also provides an interlock which will permit rotation of a protrusion 20 within an indentation 21. The invention is not limited to a particular geometric configuration of the protrusion 12 and corresponding indentation 13. Various geometric shapes may be utilized so long as the shape of the indentation 13 is conformed as necessary to accept the shape of the protrusion 12 in a male/female relationship.

The landscaping block of the present invention may be constructed of brick, concrete, or ceramic tile composition, or other like suitable material.

Figure 4:
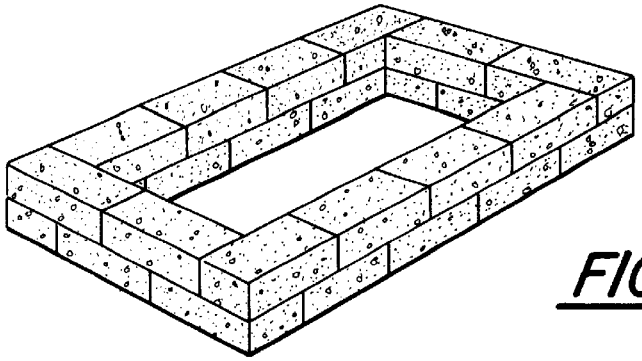
FIG. 4 is a perspective view of a polygonal structure comprised of a plurality of blocks.
Figure 5:
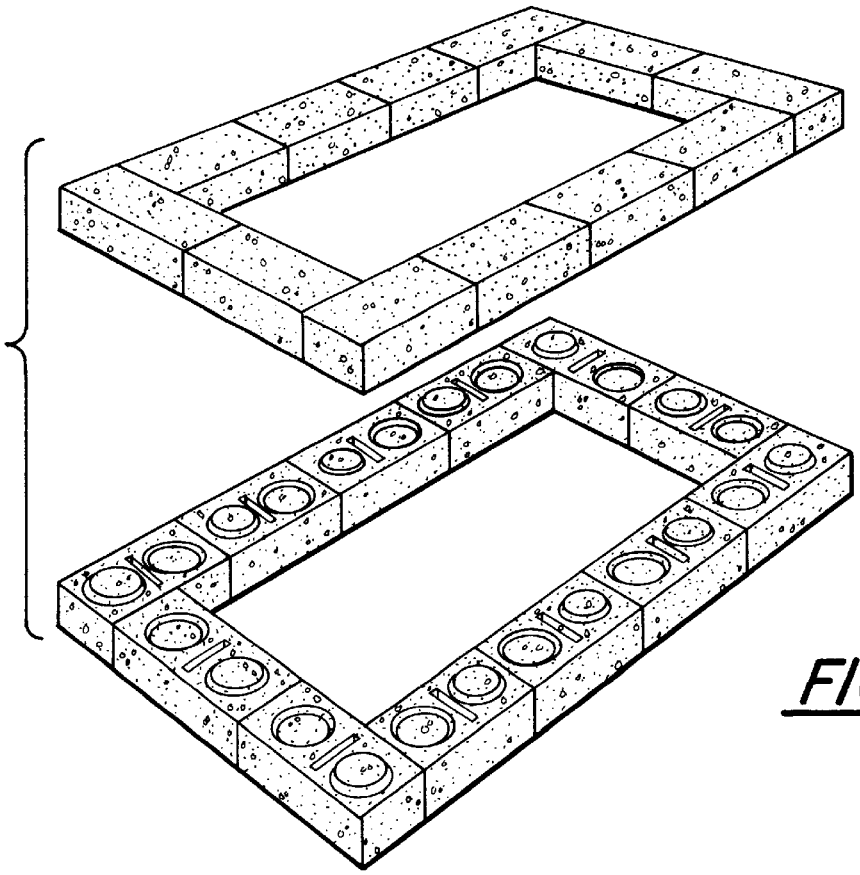
FIG. 5 is an expanded view of the polygonal structure shown in FIG. 4.
Figure 6:
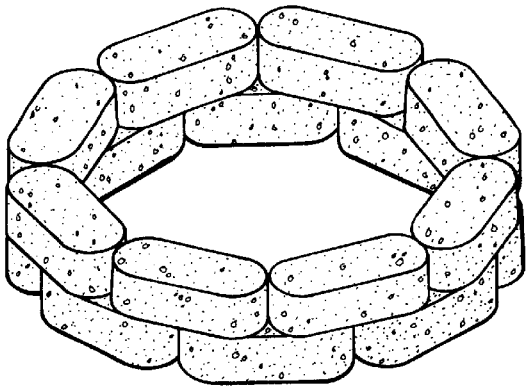
FIG. 6 is a perspective view of an approximately circular structure comprised of blocks as shown in FIG. 2.
Figure 10:
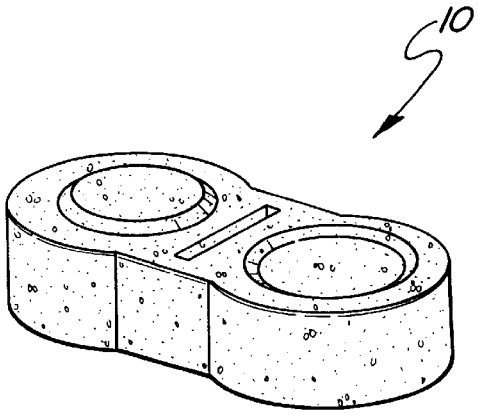
FIG. 10 is a perspective view of a second alternative stylized block.
Figure 11:
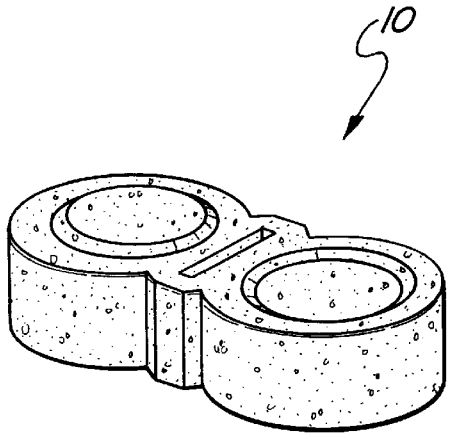
FIG. 11 is a perspective view of a third alternative of a stylized block.

As shown in FIG. 14, multiples of the block 10 may be used in series to create landscaping structures by interlocking the indentation 21 of a first block 10*a* with the protrusion 20 of a next block 10*b*, the indentation 21 of said next block 10*b* with a protrusion 20 of a further next block 10*c* and the indentation 21 of said further next block 10*c* with the protrusion 20 of a further next block 10*d*, and proceeding in like manner with each next adjoining block 10 depending upon the total number of blocks in the structure, providing a structure in which the interlocking, through each alternative protrusion 20 and indentation 21 of adjoining blocks, creates a structure which is interlocked horizontally, and provides double the depth dimension 11 of the singular block 10 and is likewise interlocked vertically. In a further preferred embodiment of the invention, structures may be constructed of interlocked blocks 10 approximating the shape of a circle, as shown in FIGS. 6 and 7, a rectangle, as shown in FIGS. 4 and 5, or other geometric configurations which may be linear, curved, or angled, and which may, or may not, provide closure.

Whereas, a preferred embodiment of the invention has been illustrated and described in detail, it will be apparent that various changes may be made in the disclosed embodiment without departing from the spirit of the invention.

What is claimed is:

1. A block for landscaping purposes, comprising a planar surface;

said planar surface further comprising a protrusion in the form of a truncated cone, defined upon and projecting from said planar surface and a corresponding indentation defined upon said planar surface, said indentation configured to accept the protrusion of another like block in a male/female relationship.

2. A block for landscaping purposes, comprising a planar surface;

said planar surface further comprising a protrusion defined upon and projecting from said planar surface and a corresponding indentation defined upon said planar surface, said indentation configured to accept the protrusion of another like block in a male/female relationship;

said protrusion and indentation linearly aligned so bisect said planar surface;

said planar surface having a maximum width dimension and a maximum length dimension at least as long as the maximum width dimension and the alignment of the protrusion and indentation bisecting the width dimension of the planar surface; and said protrusion is centered on one-half of the length dimension of the block and the indentation is centered on the corresponding one-half of the length dimension of the block.

3. A block according to claim 2 wherein the linear distance of the length dimension is approximately twice the linear distance of the width dimension.

4. A block according to claim 2 wherein said protrusion is in the form of a truncated cone.

5. A block according to claim 2 wherein the body of said block comprises a brick composition.

6. A block according to claim 2 wherein the body of said block comprises a concrete composition.

7. A block according to claim 2 wherein the body of said block comprises a ceramic composition.

8. A block according to claim 3 wherein said protrusion is in the form of a truncated cone.

9. A block according to claim 3 wherein the body of said block comprises a brick composition.

10. A block according to claim 3 wherein the body of said block comprises a concrete composition.

11. A block according to claim 3 wherein the body of said block comprises a ceramic tile composition.

12. A block according to claim 3 wherein said planar surface further defines a linear aperture located approximately equidistance between said protrusion and said indentation, parallel to the width dimension of the planar surface.

13. A combination of blocks for landscaping purposes, each block in said combination comprising a first outwardly, generally planar surface; a second, corresponding, oppositely outwardly generally planar surface; a perimeter for each planar surface being defined by a unitary edge; unitary side surface extending about the perimeter of the corresponding planar surfaces extending between their respective unitary edges; said first generally planar surface and second generally planar surface each having a length approximately two times its width; said first planar surface further comprising a protrusion defined upon and projecting from said first planar surface and a corresponding indentation defined upon said first planar surface, said indentation configured to accept the protrusion of another like block in a male/female relationship; said protrusion and indentation being linearly aligned so as to lengthwise bisect said first planar surface; said protrusion being centered upon one half of the length dimension of said first planar surface; said indentation being centered upon the corresponding one half the length dimension of said first planar surface, and said blocks being combined, alternatively, so that the first planar surface of each block interfaces with the first planar surface of each adjoining block so that the respective first planar surfaces of the adjoining blocks form a common boundary with the protrusion of each block conformed within the indentation of an adjoining block in a male/female relationship.

14. A combination of blocks of claim 13 wherein each of the plurality of blocks has its protrusion joined in a male/female relationship with the indentation of a first adjoining block and its indentation joined in a male/female relationship with the protrusion of a second adjoining block.

15. The combination of blocks of claim 14 wherein said blocks are aligned to form a polygonal structure.

16. The combination of blocks of claim 14 wherein said blocks are aligned to approximate a circular structure.

17. The combination of blocks of claim 14 wherein said blocks are aligned linearly.

18. The combination of blocks of claim 14 wherein said blocks are aligned to approximate an elliptical structure.

* * * * *